United States Patent [19]

Maccano

[11] Patent Number: 4,811,500

[45] Date of Patent: Mar. 14, 1989

[54] ARTICLE OF FOOTWARE HAVING AN ADJUSTABLE INSTEP SUPPORTING INSERT

[75] Inventor: Angelo Maccano, Simi Valley, Calif.

[73] Assignee: L. A. Gear, Inc., Los Angeles, Calif.

[21] Appl. No.: 11,621

[22] Filed: Feb. 6, 1987

[51] Int. Cl.[4] ..... A43B 11/00; A43B 7/18

[52] U.S. Cl. ..... 36/91; 36/50; 36/119

[58] Field of Search ..... 36/88, 91, 92, 93, 114, 36/136, 45, 50, 58.6, 57, 119, 114; 128/607, 610, 611, 602, 596

[56] References Cited

U.S. PATENT DOCUMENTS

| | | | |
|---|---|---|---|
| 1,286,787 | 12/1918 | Rokahr | 36/91 X |
| 1,593,755 | 7/1926 | Davidson | 36/37 X |
| 1,691,219 | 11/1928 | Winn | 36/51 X |
| 1,894,939 | 1/1933 | Brown et al. | 128/611 |
| 1,976,819 | 10/1934 | Weiler | 128/607 |
| 2,539,761 | 1/1951 | Whitman | 36/114 |
| 2,850,813 | 9/1958 | Williamee | 128/611 |
| 3,323,232 | 6/1967 | Danowsky | 36/91 |
| 3,533,172 | 10/1970 | Jones | 36/51 |
| 4,451,995 | 6/1984 | Antonious | 36/51 |
| 4,476,639 | 10/1984 | Zaccaria | 36/51 X |
| 4,550,511 | 11/1985 | Gamm | 36/91 X R |
| 4,642,914 | 2/1987 | Caldeira | 36/50 |

FOREIGN PATENT DOCUMENTS

| | | | |
|---|---|---|---|
| 340159 | 9/1959 | Switzerland | 128/611 |
| 340158 | 9/1959 | Switzerland | 128/611 |
| 465012 | 4/1937 | United Kingdom | 128/611 |
| 512449 | 9/1939 | United Kingdom | 128/611 |

*Primary Examiner*—Donald Watkins

*Attorney, Agent, or Firm*—Marshall A. Lerner; Matthew F. Jodziewicz

[57] ABSTRACT

An athletic shoe is described including a sole and a shoe upper attached to the sole and defining a cavity for receiving a foot. The shoe upper has a lacing portion defining lace openings for a shoe lace. The shoe upper further has sidewalls with first and second openings proximate the lacing portion. A supportive sling member is disposed in the cavity and has a widened central portion intermediate opposing side quarters. The side quarters each have a narrowed strap portion adapted to pass through the first and second openings in the shoe upper and extend outwardly therefrom. Means are provided for releasably securing, in an adjustable manner, the outwardly extending narrowed strap portions of the side quarters to the shoe upper, so as to suspend the widened central portion of the sling member in the cavity to provide support to the instep areas of the foot. Preferably the sling member is secured to the show upper by including at least one opening in each of the outwardly extending narrowed strap portions in the path of the shoe lace in an interlaced relation with the lace openings of the shoe upper.

6 Claims, 2 Drawing Sheets

ARTICLE OF FOOTWARE HAVING AN ADJUSTABLE INSTEP SUPPORTING INSERT

BACKGROUND OF THE INVENTION

1. Field of the Invention

This invention relates in general to footware, and, more particularly, to athletic footware used for sports activities including, but not limited to, aerobic dance, jazz exercise, jogging or running. The invention includes a shoe having a lightweight, flexible insert that provides an internal instep support that is adjustable by the wearer of the shoe.

2. Description of the Related Art

The modern athletic shoe is a complex and finely engineered article designed for both the comfort of the wearer and for the protection of the wearer against rigorous stressing forces placed on the foot during athletic activities. Designing the athletic shoe has become a highly refined science calling for expertise in all branches of study. Athletes, and the general public for that matter, are no longer satisfied with the old "sneakers" of yesteryear. Athletic shoes today are as varied in design and purpose as the activities for which they are worn. Shoes have been designed to provide the wearer with optimum performance for such specific activities as tennis, racquetball, football, golf, weightlifting, aerobic dance, running, jogging, etc. Each individual type of shoe is designed to provide a unique and specific combination of traction, support, and protection to enhance the athletic performance of its user.

Shoe design does not stop merely with creating a generic "football" shoe, but continues to provide a shoe that is further designed to meet and adapt to the specific characteristics of the individual user. For example, a relatively heavy user has a differently structured shoe than the shoe used by a relatively light user. Other shoes provide devices to support various parts of the foot, such as the instep or the metatarsal area, or shock absorption devices to prevent physical problems from developing.

An athletic shoe is divided into two general parts, an upper and a sole. The upper is designed to snugly and comfortably enclose the foot. The sole must provide traction, protection, and a durable wear surface.

Activities promoting physical fitness have undergone a recent surge in popularity due to the public's increased awareness of the benefits of a regular regimen of exercise in our modern sedentary society. Physical activities that place a great deal of emphasis on movement rely on a good shoe to provide the necessary traction, protection and support to the participant's feet in order to provide more helpful than harmful results.

In general, shoes required for physically demanding activities, such as aerobic dance and jazz exercise, must have a unique combination of comfort, flexibility, shock absorption, protection and foot support that is lacking in other forms of athletic shoe. Accordingly, shoes designed for other athletic activities are not appropriate as all purpose athletic footware.

Shoes currently used in sports such as jogging, aerobic dance, and the like, are shoes having an upper with a thin outsole in the forefoot and heel areas and a non-cushioning inner liner. Such general purpose shoes offer little protection against typical sporting foot injuries such as bruises, fallen arches, and tendon and ligament injuries due to shock forces. However, protective or supporting devices to minimize these problems have not been incorporated into such general purpose athletic shoes due to a desire to keep the tactile sensitivity of the foot at a maximum and the shoe weight down to a minimum.

SUMMARY OF THE INVENTION

The invention described and claimed here overcomes the problems of prior art athletic shoes by providing a shoe with a lightweight, flexible, cushioning and shock-absorbing insert which also provides support for crucial instep parts of the foot. The supportive and protective insert members have been incorporated into the shoe in a manner such that both the lightweight characteristics of the shoe and the tactile sensitivity of the foot are maintained.

The subject insert members are also capable of being quickly adjusted to meet both the changing demands of use and individual user requirements with a minimum of fuss and bother on the part of the user. The inserts are also capable of economical replacement and repair if the need for such were to arise.

In general the present invention is directed towards a shoe comprising a sole and a shoe upper attached to the sole and defining a cavity for receiving a foot. The shoe upper has a lacing portion defining lace openings for a shoe lace. The shoe upper further has first and second openings into the cavity proximate the lacing portion for a use as described below.

A supportive sling member is disposed in the cavity and has a widened central portion intermediate opposing side quarters. The side quarters each have a narrowed strap portion adapted to pass through the first and second openings in the shoe upper and extend outwardly therefrom. Means are provided for releasably securing, in an adjustable manner, the outwardly extending narrowed strap portions of the side quarters to the shoe upper, so as to suspend the widened central portion of the sling member in the cavity. The sling member is positioned in the cavity to provide support to the instep areas of the foot.

One preferred means of securing the sling member to the shoe upper comprises hook and pile fastening material having a hook fastening component and a pile fastening component. The outwardly extending narrowed strap sections extend in opposite directions across the lacing portion of the shoe upper and overlap each other longitudinally.

One of the strap sections has one of the fastening components attached to a side thereof facing the shoe upper with the other of the strap sections having the other of the fastening components attached to a side facing away from the shoe upper. In this way, the strap sections can be pulled taut in opposite directions in mutually overlapping relationships and releasably fastened to each other by the hook and pile fastening material.

A second alternative means of securing the sling member to the shoe upper comprises having at least one opening in each of the outwardly extending narrowed strap portions of the side quarters adapted to receive therethrough the shoe lace in an interlaced relation with the lace openings of the lacing portion of the shoe upper. The laces can be initially tightened and partially tied before passing through the strap portions, thereby permitting an adjustment that is independent of the comfortable fitting of the shoe.

The novel features of construction and operation of the invention will be more clearly apparent during the course of the following description, reference being had to the accompanying drawings wherein has been illustrated a preferred form of the device of the invention and wherein like characters of reference designate like parts throughout the drawings.

DESCRIPTION OF THE PREFERRED EMBODIMENTS

Figure 1:
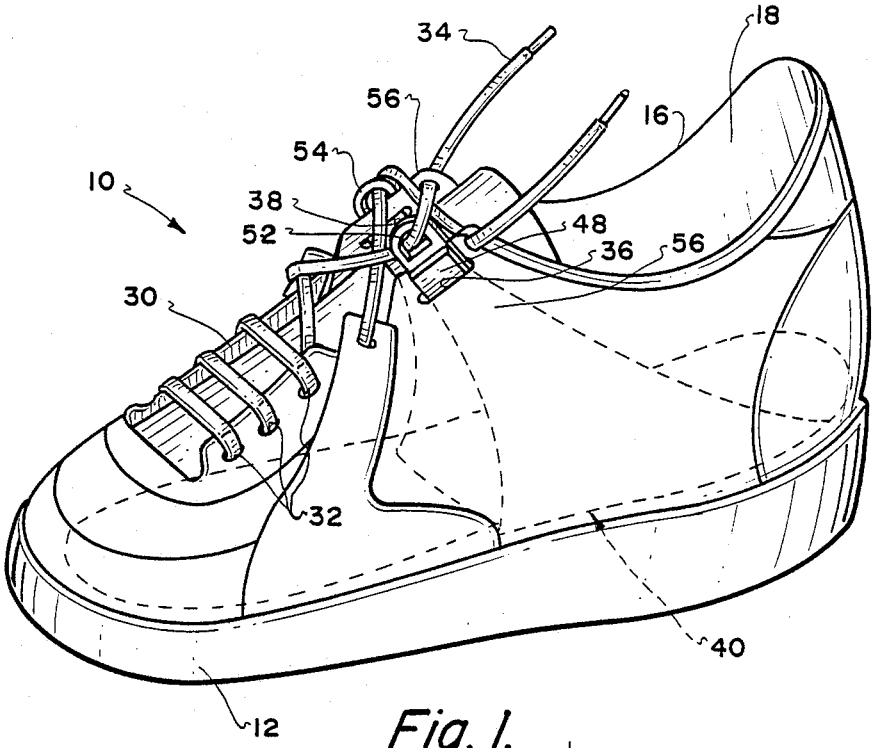
FIG. 1 is a side perspective view of an athletic shoe embodying the present invention.
Figure 3:
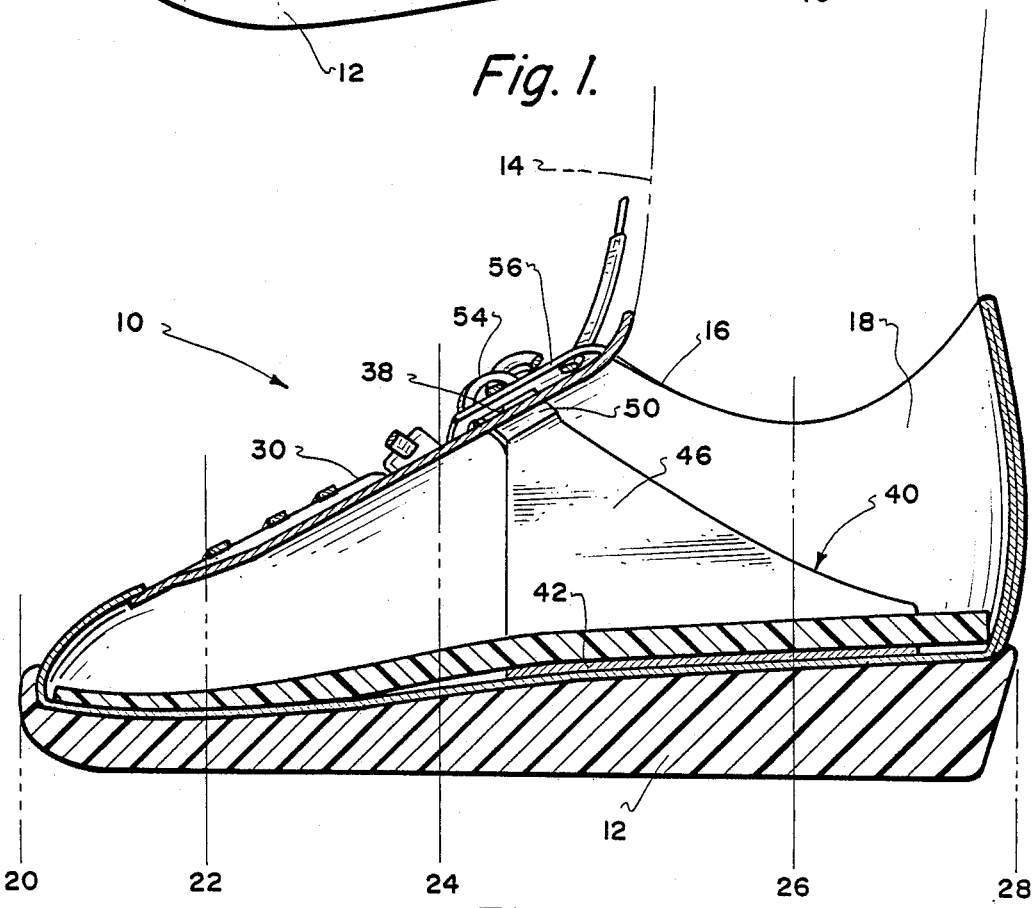
FIG. 3 is a cross-sectional view showing an athletic shoe embodying the present invention in use.

A gymnastic shoe according to the present invention is shown generally at 10 in FIGS. 1 and 3. Shoe 10 includes a sole 12, which is usually extremely flexible to allow the wearer of the shoe 10 to feel the surface below the sole 12 while still providing both traction and protection to the foot 14.

The exterior surface of the sole 12 may have any one of a number of designs formed in it to increase traction or to absorb stressing shocks that may occur to the foot 14 due to physical activity while wearing shoe 10.

Likewise, sole 12 may also be formed of a closed cell material to soften the stress on the foot and lighten the overall weight of the shoe 10.

A shoe upper 16 is attached to the sole 12 and defines a cavity 18 for receiving the foot 14. Upper 16 is preferably made from a lightweight flexible material that is strong and durable such as closely knit nylon mesh which affords the foot 14 both roominess and breathability when it is retained in cavity 18.

As can be seen from the FIGS., especially FIG. 3, the shoe 10 can be generally divided by the boundary lines into a number of functional areas, namely, the toe area between lines 20 and 22, the ball area between lines 22 and 24, the instep area between lines 24 and 26, and finally, the heel area between lines 26 and 28. Each of these areas correspond approximately to the respective areas of the foot 14 as it is retained in the cavity 18 of the shoe 10. However, these divisions, along with lines 20 through 28, are not intended to delineate precise lines of demarcation, but rather are approximations for purposes of discussing various structural and functional aspects of the invention.

The upper 16 also has a lacing portion 30 that includes a plurality of lace openings 32 for a shoe lace 34.

The upper 16 further has a first and second opening, 36, 38, respectively, in the sidewalls 56 proximate the lacing portion 30 of the shoe upper 16.

First and second openings 36, 38 are preferably elongated openings having the general shape of slits or slots in upper 16 to accommodate a purpose better described below.

Likewise, the preferred positioning of first and second openings 36, 38 is adjacent or proximate the uppermost lace openings 32 so as to accommodate the purpose also better described below.

Figure 2:
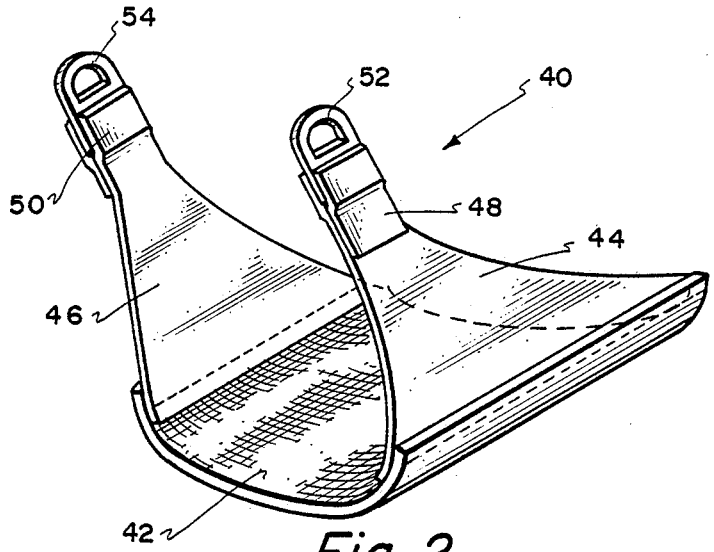
FIG. 2 is a side perspective view of the insert sling member of the present invention.

A sling member 40, generally referred to by the reference arrow, is disposed in the cavity 18 and has a widened central portion 42 intermediate opposed side quarters 44, 46. Sling member 40 is shown separated from the shoe 10 in FIGS. 2, 4 and 5 for clarity of explaination.

The widened central portion 42 of the sling member 40 is preferably fabricated of a porous elastomeric material and is shaped to anatomically conform to the instep portion of the foot 14. Generally, the instep portion of the foot 14 will be located between lines 24 and 26 as shown in FIG. 3. Such anatomical conformance will result in imparting to the widened central portion 42 a generally trapezoidal shape to receive and support the instep portion of the foot 14. The FIGS., due to their perspective viewpoint, do not specifically show the generally trapezoidal shape of the widened central portion 42.

The side quarters 44, 46 each have a narrowed strap portion 48, 50 respectively. Narrowed strap portions 48, 50 are each adapted to pass through the first and secod sidewall openings 36, 38 respectively, in the shoe upper 16 and extend outwardly therefrom. Accordingly, the preferred shape for first and second openings 36, 38 is a slot or slit like aperture that will permit the narrowed strap portions 48, 50 to pass therethrough without any binding or "bunching".

There is at least one opening 52, 54 respectively, in each of the outwardly extending narrowed strap portions 48, 50 of the side quarters 44, 46, adapted to receive therethrough the shoe lace 34 in an interlaced relation with the lace openings 32 of the lacing portion 30 of the shoe upper 16. The shoe lace 34 then releasably secures the sling member 40 to the shoe upper 16 so that the widened central portion 42 of the sling member 40 is adjustably "suspended" in the cavity 18.

In order to permit the most efficient interlacing of the openings 52, 54 with the lace openings 32 by the shoe lace 34, it is preferred that the first and second openings 36, 38 be located proximate or adjacent the lacing portion 30 of the shoe upper 16. In this manner the outwardly extending portions of the narrowed strap portions 48, 50 can be readily positioned to accommodate the shoe lace 34 without having to overly inconvenience the individual lacing the shoe 10.

Figure 4:
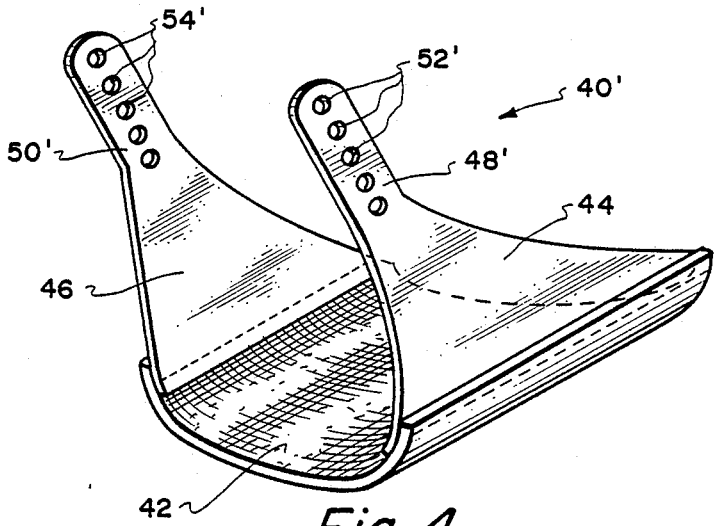
FIG. 4 is a view of an alternate embodiment of the insert sling member of the present invention.

Likewise, it is also preferred in an alternate embodiment of the invention as shown in FIG. 4, to have a plurality of openings 52', 54', in the outwardly extending portions of the narrowed strap portions 48', 50' so as to permit the user of the shoe 10 to adjust the support provided by sling member 40' by adjusting the suspension of the widened central portion 42 of the sling member 40' in the cavity 18. In this manner the openings 52', 54' and the lace openings 32 are positioned with regard to one another so that tightening of the shoe lace 34 threaded through all the openings 52' and 54' in the narrowed strap portions 48', 50' and the lace openings 32, draws the widened central portion 42 of the sling member 40' upwardly against the instep of the foot 14 to provide adjustable support therefor.

Figure 5:
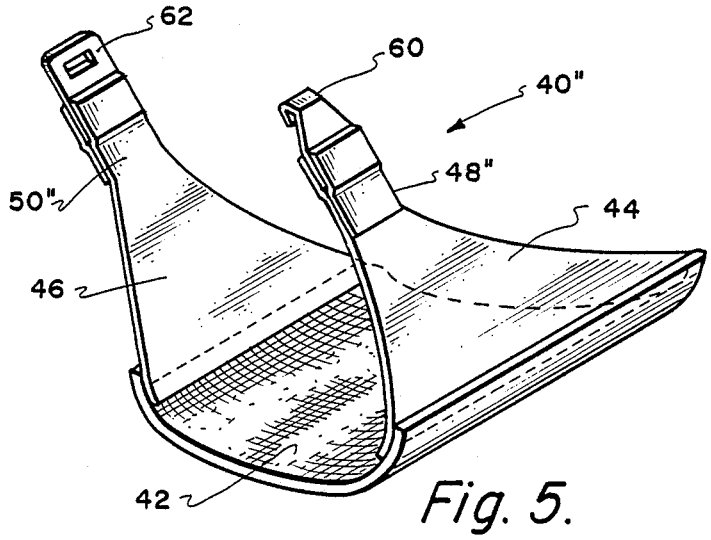
FIG. 5 is a view of another alternate embodiment of the insert sling member of the present invention.

An alternate means, illustrated in FIG. 5, for securing the sling member 40'' to the upper 16 comprises hook and loop fastening material 60, 62, respectively. The outwardly extending portions of the narrowed strap sections 48'', 50'' extend in opposite directions across the lacing portion 30 of the shoe upper 16 and overlap each other longitudinally. One of the strap sections 48'', 50'', has one of the fastening components 60 attached to a side thereof facing the shoe upper 16, with the other of the strap sections 48'', 50'' having the other of the fastening components 62 attached to a side facing away from the shoe upper. In this manner the narrowed strap sections 48'', 50'', can be pulled taut in opposite directions in mutually overlapping relationships and releasably fastened to the shoe upper 16 by the hook and loop fastening material 60, 62. Preferably, the hook fastening material 60 faces the shoe upper and the loop fastening material 62 faces outward, so that a relatively narrow hook section can be fastened to a relatively wide loop section which is relatively soft to the touch.

Other securement methods that can be used with the present invention include, but are not limited to, having the outwardly extending portions 48, 50, of the sling meber secured by a buckle combination or through a loop attached to the exterior surface of the shoe upper 16.

With any of the securement methods described above it will be seen that the sling member 40 can be removed from the shoe upper 16 and replaced or adjusted if the need arises.

Shoe 10 is worn by first inserting foot 14 into the cavity 18 and bringing the areas of the foot 14 into general alignment with the areas indicated by lines 20 through 28. The instep portion of the foot 14 will be generally in the area bounded by lines 24 to 26 and will be supported by the widened central portion 42 of the sling member 40. The upper 16 of the shoe 10 is then drawn tightly to foot 14 by drawing the shoe lace 34 thereby pulling the sling member 40 and lacing portion 30 of the upper 16 into a tight arrangement about the upper portion of the foot 14. If the need arises to adjust the support that the widened central portion 42 of the sling member 40 gives to the instep portion of the foot 14, the shoe lace 34 need only be rethreaded through the openings 52, 54 in narrowed strap portion 48, 50 of the side quarters 44, 46 of the sling member 40 to pull the sling member 40 into a tighter or looser relation with the shoe upper 16.

If it becomes necessary to replace the sling member 40, it need only be released from its interlaced relationship with-lace openings 32 and withdrawn through first and second openings 36, 38 thereby removing it from its relation with the shoe upper 16 and allowing a substitute sling member 40 to be inserted thereinto.

The invention described above is, of course, susceptible to many variations, modifications and changes, all of which are within the skill of the art. It should be understood that all such variations, modifications and changes are within the spirit and scope of the invention and of the appended claims. Similarly, it will be understood that it is intended to cover all changes, modifications and variations of the example of the invention herein disclosed for the purpose of illustration which do not constitute departures from the spirit and scope of the invention.

What is claimed is:

1. A shoe comprising:

a flexible shoe sole;

a shoe upper attached to said shoe sole and defining a cavity for receiving a foot, said shoe upper having left and right side walls, each of said side walls having a separate lacing portion which includes a row of lace openings for receiving a shoe lace;

each of said sidewalls also having an elongated slit-like opening located between the next-to-uppermost and uppermost ones of said lace openings and substantially aligned therewith;

a sling member disposed within said cavity, having opposing side quarters and a widened central portion intermediate said side quarters, said widened central portion being fabricated of an elastomeric material and being shaped to support the instep portion of the foot;

said side quarters each having an upwardly extending narrowed strap portion passing through a respective one of said slit-like openings in said shoe upper, each of said narrowed strap portions having an opening in the upper end thereof adapted to receive a shoe lace therethrough; and a shoe lace extending through the next-to-uppermost lace opening in each of said side walls, hence through said upper end opening in the opposite one of said narrowed strap portions, and thence reversing its direction and extending back through the uppermost lace opening in the same side wall, for releasably securing said outwardly extending narrowed strap portions of said sling member to said shoe upper, and so that tightening of said shoe lace suspends said elastomeric central portion of said sling member in said cavity in an adjustable manner.

2. A shoe as in claim 1 wherein said elastomeric central portion of said sling is a separate member, each of said side quarters is widest at its lowermost end and attached to one side of said elastomeric central portion of said sling, and which further includes a shortened auxiliary strap piece attached in parallel relation to the upper end of said narrowed strap portion of each of said side quarters to form a socket and a separate eyelet secured in said socket to form said lace-receiving opening.

3. A shoe as in claim 1 which further includes an elastomeric insole extending the full length of said cavity, said insole in the instep area resting upon and being supported by said elastomeric central portion of said sling.

4. A shoe as in claim 2 which further includes an elastomeric insole extending the full length of said cavity, said insole in the instep area resting upon and being supported by said elastomeric central portion of said sling.

5. A shoe comprising:

a shoe sole;

a shoe upper attached to said shoe sole and defining a cavity for receiving a foot, said shoe upper having left and right side walls, each of said side walls having a separate lacing portion which includes a row of lace openings for receiving a shoe lace, each of said sidewalls also having an elongated slit-like opening located between the uppermost and next-to-uppermost ones of said lace openings;

a sling member disposed within said cavity, having opposing side quarters and a widened central portion intermediate said side quarters, said widened central portion being shaped to support the instep portion of the foot, said side quarters each having an upwardly extending narrowed strap portion passing through a respective one of said slit-like openings in said shoe upper, each of said narrowed strap portions having an opening in its upper end adapted to receive a shoe lace therethrough; and a shoe lace extending through the next-to-uppermost lace opening in each of said side walls, hence through said upper end opening in the opposite one of said narrowed strap portions, and thence reversing its direction and extending back through the uppermost lace opening in the same side wall, for releasably securing said outwardly extending narrowed strap portions of said sling member to said shoe upper, and so that tightening of said shoe lace suspends said central portion of said sling member in said cavity in an adjustable manner.

6. A shoe as claimed in claim 5 wherein said central portion of said sling is made of an elastomeric material.

* * * * *